US011910862B2

(12) United States Patent
Bouchard Fortin et al.

(10) Patent No.: US 11,910,862 B2
(45) Date of Patent: Feb. 27, 2024

(54) VENTILATED HELMET PREVENTING DEPOSITION OF FOG ON A PROTECTIVE EYEWEAR, AND A METHOD AND USE OF THE SAME

(71) Applicant: KIMPEX INC., Drummondville (CA)

(72) Inventors: Nicolas Bouchard Fortin, Racine (CA); Robert Handfield, St-Lucien (CA); Jean-Simon Lévesque, Victoriaville (CA); Étienne Gilbert, Beloeil (CA); Hachimi Fellouah, Sherbrooke (CA); Marouen Dghim, Sherbrooke (CA)

(73) Assignee: KIMPEX INC., Drummondville (CA)

( * ) Notice: Subject to any disclaimer, the term of this patent is extended or adjusted under 35 U.S.C. 154(b) by 0 days.

(21) Appl. No.: 18/334,139

(22) Filed: Jun. 13, 2023

(65) Prior Publication Data

US 2023/0320451 A1 Oct. 12, 2023

Related U.S. Application Data

(63) Continuation of application No. 17/525,523, filed on Nov. 12, 2021, which is a continuation of application (Continued)

(51) Int. Cl.

| | |
|---|---|
| ***A42B 3/00*** | (2006.01) |
| ***A42B 3/24*** | (2006.01) |
| ***A42B 3/28*** | (2006.01) |

(52) U.S. Cl.

CPC ..... *A42B 3/24* (2013.01); *A42B 3/281* (2013.01); *A42B 3/283* (2013.01)

(58) Field of Classification Search

CPC ..... A42B 3/24; A42B 3/281; A42B 3/283

See application file for complete search history.

(56) References Cited

U.S. PATENT DOCUMENTS 3,838,466 A * 10/1974 Poirier ..... A61F 9/028 2/10

4,054,953 A * 10/1977 De Barsy ..... A42B 3/283 2/425

(Continued)

FOREIGN PATENT DOCUMENTS

| | | |
|---|---|---|
| CA | 2336548 C | 12/2009 |
| DE | 3233467 C2 | 3/1985 |
| GB | 2451429 A | 2/2009 |

*Primary Examiner* — Richale L Quinn

(74) *Attorney, Agent, or Firm* — Myers Bigel, P.A.

(57) ABSTRACT

A ventilated helmet is provided. The helmet includes a shell defining a cavity, the shell having a front section provided with an opening to allow the wearer to see. The helmet also includes a transparent shield adapted having an inner surface and being adapted to substantially close the opening. Finally, the helmet includes a ventilation system having an evacuation subsystem adapted to create an evacuation airflow to evacuate humid air within the cavity to a surrounding environment. The ventilation system further has a pressurizing subsystem adapted to admit a pressurizing airflow within the cavity to create a high-pressure zone and a low-pressure zone within the cavity, wherein when in use, the wearer exhales air within the low-pressure zone, and wherein the high-pressure zone prevents air within the cavity from travelling from the low-pressure zone to the high-pressure zone. A method of evacuating humid air from the cavity is also provided.

13 Claims, 16 Drawing Sheets

Related U.S. Application Data

No. 15/956,341, filed on Apr. 18, 2018, now Pat. No. 11,202,482.

(60) Provisional application No. 62/486,531, filed on Apr. 18, 2017.

(56) References Cited

U.S. PATENT DOCUMENTS 4,514,864 A * 5/1985 Huber ..... A42B 3/24 2/424
4,555,816 A 12/1985 Broersma
4,667,348 A * 5/1987 Sundahl ..... A42B 3/24 2/424
5,093,937 A * 3/1992 Kamata ..... A42B 3/283 2/424
5,093,938 A 3/1992 Kamata
5,099,523 A 3/1992 Broersma
5,170,510 A 12/1992 Nava
5,170,511 A 12/1992 Kamata
5,361,419 A 11/1994 Bernstein
5,388,277 A 2/1995 Taniuchi
5,394,566 A * 3/1995 Hong ..... A42B 3/283 2/424
6,055,666 A 5/2000 Eklund et al.
6,317,891 B1 11/2001 Gafforio
6,405,382 B2 * 6/2002 Shida ..... A42B 3/283 2/424
6,425,143 B1 * 7/2002 Benedict ..... A42B 3/281 2/424
6,640,345 B2 * 11/2003 Tanaka ..... A42B 3/24 2/424
6,966,067 B1 * 11/2005 Lusk ..... A42B 3/28 2/9
7,207,071 B2 * 4/2007 Pierce ..... A42B 3/281 2/424
7,716,754 B1 5/2010 Ross
7,735,157 B2 * 6/2010 Ikeda ..... A42B 3/281 2/424
7,814,578 B2 10/2010 Kosel et al.
7,987,525 B2 * 8/2011 Summers ..... A42B 3/281 2/410
8,176,575 B2 * 5/2012 Tsuzuki ..... A42B 3/24 2/424
10,765,166 B2 9/2020 Krishnan
11,202,482 B2 * 12/2021 Bouchard Fortin ..... A42B 3/24
2002/0104153 A1 * 8/2002 Benedict ..... A42B 3/24 2/424
2003/0005510 A1 * 1/2003 Tanaka ..... A42B 3/24 2/424
2003/0093853 A1 * 5/2003 Maloney ..... A42B 3/185 2/421
2004/0158914 A1 * 8/2004 Tanaka ..... A42B 3/0493 2/410
2014/0196199 A1 * 7/2014 Huffman ..... A42B 3/20 2/421
2016/0021966 A1 1/2016 Warmouth et al.
2017/0120134 A1 5/2017 Warmouth et al.
2018/0206584 A1 7/2018 Allen et al.
2018/0295926 A1 * 10/2018 Bouchard Fortin ... A42B 3/281
2020/0268090 A1 * 8/2020 Levesque ..... A42B 3/222
2021/0321710 A1 * 10/2021 Abraham ..... A63B 71/10
2022/0225721 A1 * 7/2022 Cafiero ..... A42B 3/245

* cited by examiner

VENTILATED HELMET PREVENTING DEPOSITION OF FOG ON A PROTECTIVE EYEWEAR, AND A METHOD AND USE OF THE SAME

RELATED APPLICATIONS

This application is a continuation of U.S. patent application Ser. No. 17/525,523, filed Nov. 12, 2021, which itself is a continuation of U.S. patent application Ser. No. 15/956,341, filed Apr. 18, 2018, now U.S. Pat. No. 11,202,482, which itself claims the benefit of and priority to U.S. Provisional Patent Application No. 62/486,531, filed Apr. 18, 2017, the contents of which are incorporated herein by reference in their entireties.

TECHNICAL FIELD

The technical field generally relates to a protective helmet adapted for use in various activities and sports such as snowmobiling and motorcycling among others, and more specifically relates to a protective helmet having a ventilation system to prevent deposition of fog on a transparent shield thereof. The technical field also relates to a method for preventing deposition of fog on the protective eyewear.

BACKGROUND

The structure of a helmet is well-known in the art. It includes an external shell provided with a cavity for receiving the head of a wearer and a front opening allowing the wearer to see. In most cases, the helmet is also provided with some sort of protective eyewear to be mounted across, or to close, the front opening in order to protect the upper part of the wearer's face (e.g., eyes). The helmet therefore offers protection for the entire head of the person wearing it. Non-limiting examples of common eyewear includes goggles and visors, among others.

While wearing a helmet, air can travel within the cavity of the helmet and cause fog to form on the inner surface of the eyewear. Prior art helmets such as the one of British patent GB2451429 are provided with openings in the shell to help evacuate the air from the cavity to the surrounding environment. This is done to prevent fogging up the interior surface of the protective eyewear.

However, these openings are often located on top of the shell, which results in an airflow travelling upwardly within the cavity, effectively dragging the air exhaled by the wearer upwardly as well. Consequently, the exhaled air travels in front or sometimes even through the protective eyewear, risking said eyewear to fog up, obstructing the wearer's vision.

Therefore, there is a strong need for a ventilated helmet which overcomes prior art deficiencies, more particularly a ventilated helmet provided with a ventilation system adapted to prevent deposition of fog on the protective eyewear.

SUMMARY

According to an aspect, a ventilated helmet is provided. The ventilated helmet including a shell defining a cavity for receiving a wearer's head, the shell having a bottom section, a top section, a back section and a front section, the front section being provided with an opening to allow the wearer to see. The ventilated helmet further includes a transparent shield connected to the shell and being adapted to substantially close the opening, the transparent shield having an inner surface facing the cavity. Finally, the ventilated helmet also includes a ventilation system having an evacuation subsystem adapted to create an evacuation airflow to evacuate the air from within the cavity to a surrounding environment. The evacuation subsystem including an evacuation inlet communicating with the cavity, an evacuation outlet communicating with the surrounding environment, and a channel fluidly connecting the evacuation inlet and evacuation outlet. The ventilation system further having a pressurizing subsystem adapted to admit a pressurizing airflow within the cavity, the pressurizing airflow being adapted to create a high-pressure zone and a low-pressure zone within the cavity. When using the ventilated helmet, the mouth and nose of the wearer are positioned in the low-pressure zone, and wherein the high-pressure zone prevents air within the cavity from travelling from the low-pressure zone to the high-pressure zone.

According to a possible embodiment, the low-pressure zone of the cavity is substantially defined in the bottom section of the shell, and the high-pressure zone is substantially defined in the top section of the shell.

According to a possible embodiment, the evacuation inlet is positioned within the cavity, in the low-pressure zone, proximate the front section.

According to a possible embodiment, the evacuation outlet is positioned on the shell, in the bottom section thereof, proximate the back section.

According to a possible embodiment, the channel includes a converging section proximate the evacuation inlet, the converging section having a reducing cross-sectional area adapted to accelerate the air flowing within the channel.

According to a possible embodiment, the evacuation subsystem further includes an auxiliary inlet fluidly connecting the surrounding environment with the channel to create a vacuum therein to urge the air within the cavity toward the evacuation inlet so as to be evacuated via the evacuation outlet.

According to a possible embodiment, the auxiliary inlet is positioned on the shell, in the bottom section thereof, proximate the front section.

According to a possible embodiment, the converging section is between the auxiliary inlet and evacuation inlet.

According to a possible embodiment, the auxiliary inlet is selectively adjustable to control access of air flowing therethrough.

According to a possible embodiment, the evacuation airflow remains in the bottom section of the shell.

According to a possible embodiment, the channel is defined within a thickness of the shell.

According to a possible embodiment, the evacuation subsystem includes insulating material provided between the channel and the helmet shell.

According to a possible embodiment, the pressurizing subsystem includes a pressurizing inlet positioned on the shell, below the transparent shield.

According to a possible embodiment, the pressurizing inlet is selectively adjustable to control the access of the pressurizing airflow within the cavity.

According to a possible embodiment, the pressurizing inlet is in fluid communication with the high-pressure zone.

According to a possible embodiment, the pressurizing subsystem includes a deflector positioned within the cavity behind the pressurizing inlet, the deflector being adapted to direct the pressurizing airflow toward the top section along the inner surface of the transparent shield.

According to a possible embodiment, the ventilation system further includes a frontal subsystem adapted to create a frontal airflow within the cavity, the frontal airflow being adapted to provide fresh air to the bottom section of the shell and to further drag the air located in the cavity toward the evacuation inlet.

According to a possible embodiment, the frontal subsystem and evacuation subsystems are fluidly connected with the low-pressure zone.

According to a possible embodiment, the frontal subsystem includes a frontal inlet fluidly connecting the surrounding environment with the cavity, and a frontal deflector positioned within the cavity behind the frontal inlet, the frontal deflector being adapted to direct the frontal airflow toward the evacuation inlet.

According to a possible embodiment, the frontal inlet and evacuation inlet are in fluid communication with the low-pressure zone.

According to a possible embodiment, the frontal inlet is selectively adjustable to control the access of the frontal airflow within the cavity.

According to a possible embodiment, the frontal inlet is positioned on the shell, in the bottom section thereof, proximate the front section.

According to a possible embodiment, the frontal inlet is positioned below the pressurizing inlet.

According to a possible embodiment, the ventilated helmet further includes a separator connected to the shell within the cavity, the separator being adapted to at least partially separate the high-pressure zone from the low-pressure zone.

According to a possible embodiment, the evacuation subsystem includes left and right evacuation subsystems respectively provided on left and right sides of the shell.

According to another aspect, a method of evacuating humid air from within a cavity of a helmet is provided. The method including the steps of having the helmet move through the surrounding air; admitting air from the surrounding environment within the cavity through a pressurizing inlet to pressurize a top section thereof, urging the humid air toward the evacuation airflow in the bottom section; and defining an evacuation airflow in a bottom section of the cavity to drag and evacuate humid air from within the cavity to a surrounding environment.

According to a possible embodiment, the evacuation airflow travels through at least one channel laterally connected to the helmet, and wherein the evacuation airflow drags the humid air within the channel.

According to a possible embodiment, the channel is surrounded by an insulating material.

According to a possible embodiment, the method further includes the step of reducing a cross-section of the channel along a length thereof to increase velocity of the evacuation airflow, therefore increasing the drag of humid air within the channel.

According to a possible embodiment, the method further includes the step of admitting a frontal airflow from the surrounding environment within the cavity through a frontal inlet, the frontal airflow being directed toward the channel to increase the drag of humid air therein.

According to a possible embodiment, the method further includes the step of admitting air form the surrounding environment directly within the channel through an auxiliary inlet to increase the drag of humid air within the channel.

DETAILED DESCRIPTION

It should be understood that the elements of the drawings are not necessarily depicted to scale, since emphasis is placed upon clearly illustrating the elements and structures of the present embodiments. In the following description, the same numerical references refer to similar elements. Furthermore, for the sake of simplicity and clarity, namely so as to not unduly burden the figures with several reference numbers, not all figures contain references to all the components and features, and references to some components and features may be found in only one figure, and components and features of the present disclosure which are illustrated in other figures can be easily inferred therefrom. The embodiments, geometrical configurations, materials mentioned and/or dimensions shown in the figures are optional, and are given for exemplification purposes only.

As will be explained below in relation to various embodiments, a ventilated helmet for preventing deposition of fog on a transparent shield thereof is provided. The ventilated helmet includes a ventilation system for evacuating warm and humid air from within the cavity of the helmet to the surrounding environment. It should be understood that the expression "transparent shield" can refer to any suitable accessory used to protect the wearer's eyes while wearing the helmet, such as goggles or a visor (or a portion thereof). In the context of the present disclosure, the transparent shield will generally refer to the shield used in conjunction with a visor of the helmet, as is well known in the art of sports helmets. The ventilation system can include a plurality of subsystems configured to cooperate with each other to improve the evacuation of humid air from the cavity in order to prevent fog deposition on the transparent shield.

Figure 1:
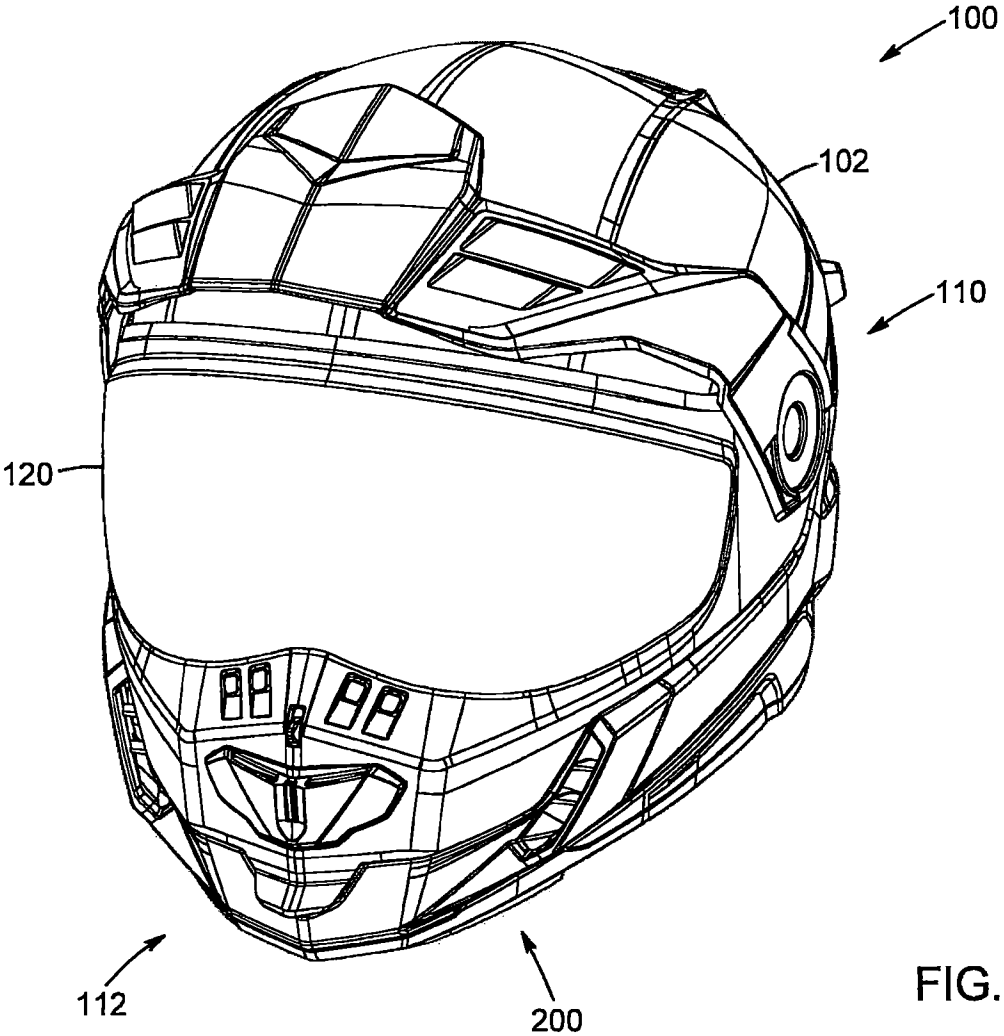
FIG. 1 is a perspective view of a ventilated helmet according to an embodiment.
Figure 2:
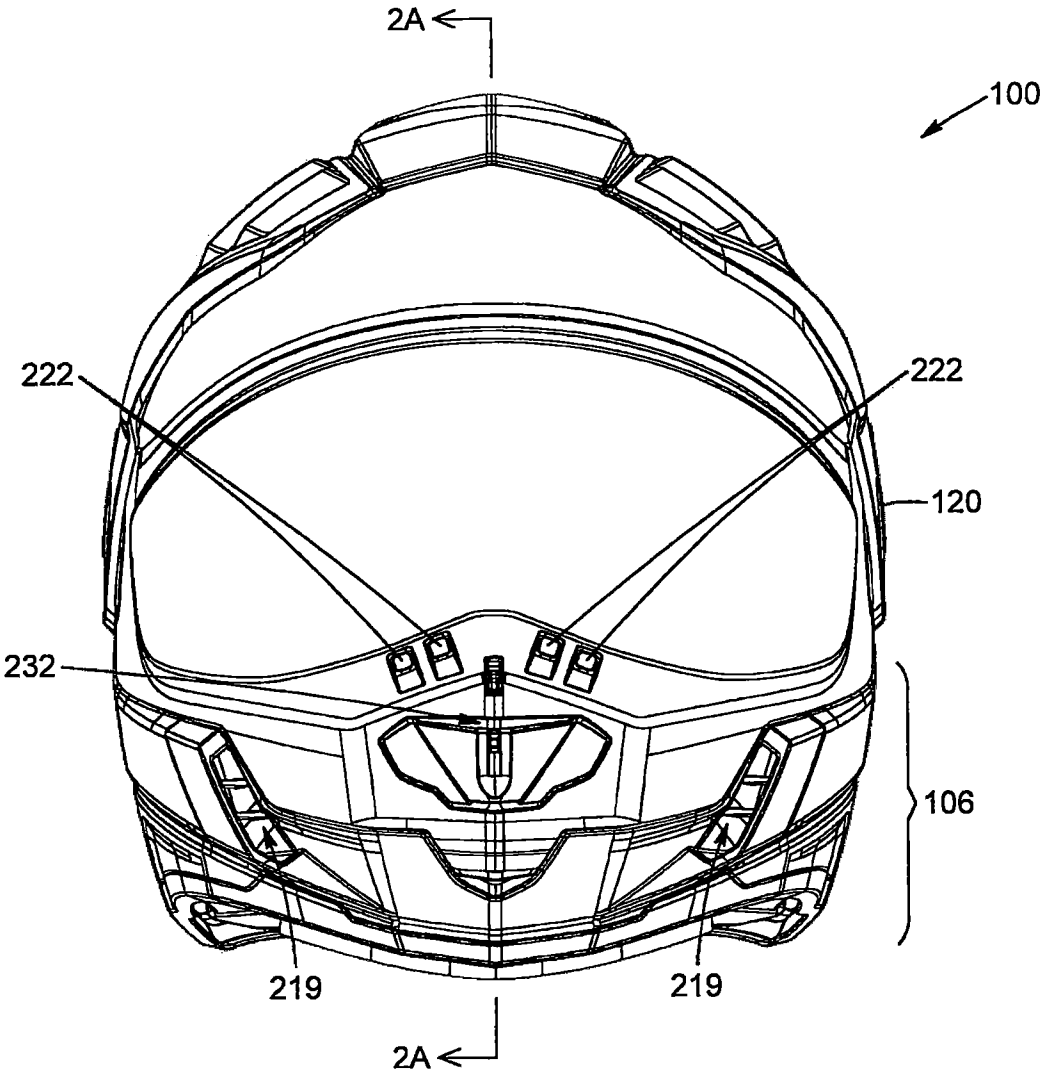
FIG. 2 is a front elevation view of the helmet shown in FIG. 1.
Figure 2A:
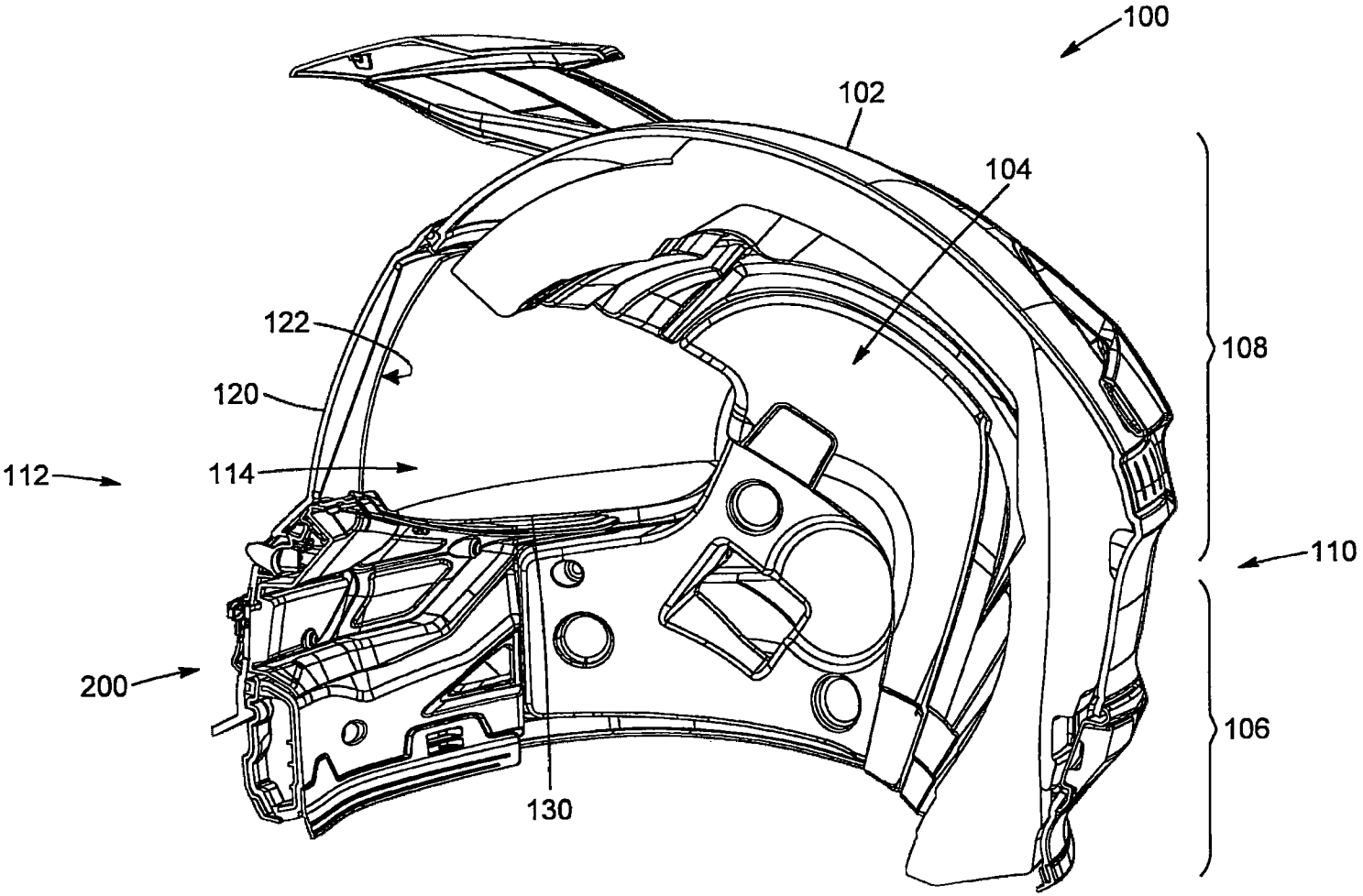
FIG. 2A is a sectional view of the helmet shown in FIG. 2 taken along cross-section lines 2A-2A of FIG. 2.

With reference to FIGS. 1 to 2A, a ventilated helmet 100 according to an embodiment is provided. The ventilated helmet 100 includes a helmet shell 102 defining a cavity 104 for receiving a wearer's head. The cavity 104 can be lined with a layer of foam-like material such as expanded polystyrene (EPS) for example. It should be readily understood that the EPS liner, and overall helmet shell 102, can be configured to provide comfort and protection to the wearer of the helmet 100. In this embodiment, the helmet shell 102 includes a bottom section 106, a top section 108, a back section 110 and a front section 112. It should be apparent that the front section 112 is provided with an opening 114 to allow the wearer to see. In some embodiments, the portion of the helmet shell 102 provided below the opening 114 substantially corresponds to the bottom section 106, while the opening 114 itself and the portion of the helmet provided above the opening 114 substantially corresponds to the top section 108. It should thus be understood that the mouth and nose of the wearer are located within the cavity 104, in the bottom section 106, and that the air breathed by the wearer is exhaled within the bottom section 106. However, it is appreciated that other configurations and/or delimitation of the helmet 100 are possible.

In addition, the helmet 100 includes a transparent shield 120 mounted to the helmet shell 102. More specifically, the transparent shield 120 is mounted to the front section 112 of the helmet in order to protect the wearer's eyes and face from wind and various debris. Therefore, it should be understood that the transparent shield 120 can be adapted to substantially close the opening 114 to effectively protect the wearer. It is appreciated that the transparent shield 120 can be pivotally mounted to the helmet shell 102 and is therefore operable between a closed configuration and an open configuration. It should also be apparent that the transparent shield has an inner surface 122 which faces the cavity 104 when in the closed configuration, as seen in FIG. 2A.

Figure 3:
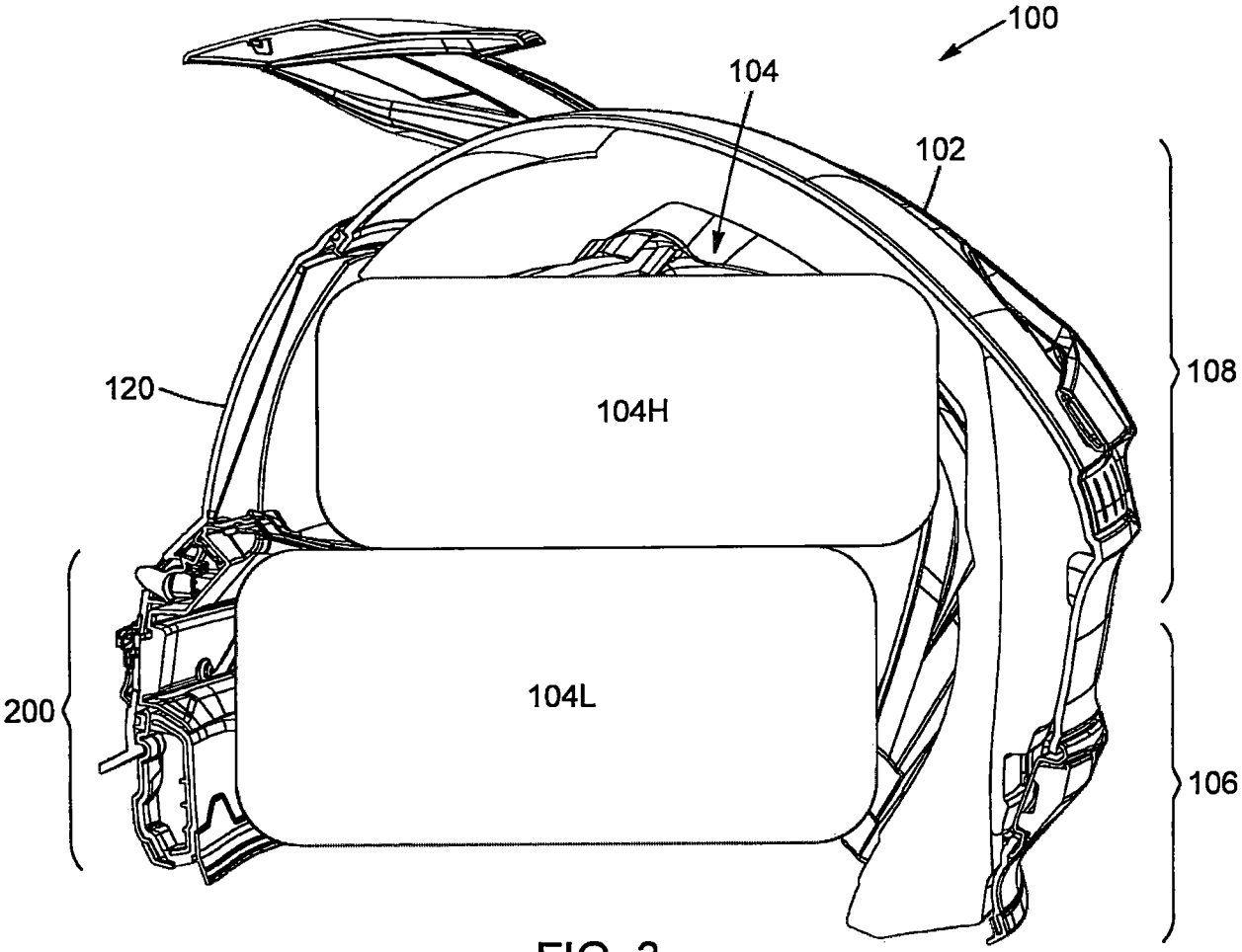
FIG. 3 is the sectional view of the helmet shown in FIG. 2A, showing a cavity separated in a high-pressure zone and low-pressure zone, according to an embodiment.

Now referring to FIG. 3, in addition to FIG. 2A, the helmet 100 further includes a ventilation system 200 adapted to evacuate warm and humid air from within the cavity 104 to effectively prevent fog from gathering on the transparent shield 120 (e.g., on the inner surface 122). In this embodiment, it is appreciated that the aforementioned warm and humid air is, or at least includes, the air exhaled by the wearer. In some embodiments, the ventilation system 200 can be configured to substantially prevent fluid communication between the bottom and top sections 106, 108, therefore maintaining the humid air (i.e., exhaled air) within the bottom section 106 of the shell 102. For example, when in use, the ventilation system 200 can pressurize a portion of the cavity 104 in a manner that will be described further below, effectively defining a high-pressure zone 104H and a low-pressure zone 104L. As seen in FIG. 3, the low-pressure zone 104L can be substantially defined in the bottom section 106 while the high-pressure zone 104H can be substantially defined in the top section 108. It is thus appreciated that the high-pressure zone 104H can prevent the air within the cavity 104 from travelling from the low-pressure zone 104L to the high-pressure zone 104H due to pressure differentiation.

Referring more specifically to FIG. 2A, the helmet 100 can include a separator 130 connected to the helmet shell 102, within the cavity 104, to at least partially separate the high-pressure zone 104H from the low-pressure zone 104L. The separator 130 can be positioned below the transparent shield 120 to substantially separate/seal the nose and mouth of the wearer from the high-pressure zone, and therefore from the inner surface 122. In some embodiments, the helmet shell 102 includes a ridge extending inwardly within the cavity on which the separator 130 can be connected. As such the separator 130 can similarly extend inwardly within the cavity 104 to contact and conform to the face of the wearer around the nose and below the eyes to further prevent exhaled air from reaching the inner surface 122. It is appreciated that the separator 130 is preferably made from a flexible material such as rubber or foam so as not to cause discomfort to the wearer. However, it is appreciated that the above-description of the separator 130 is exemplary, and that other configurations, materials and/or locations, or no separator at all, can be suitable.

Figure 4:
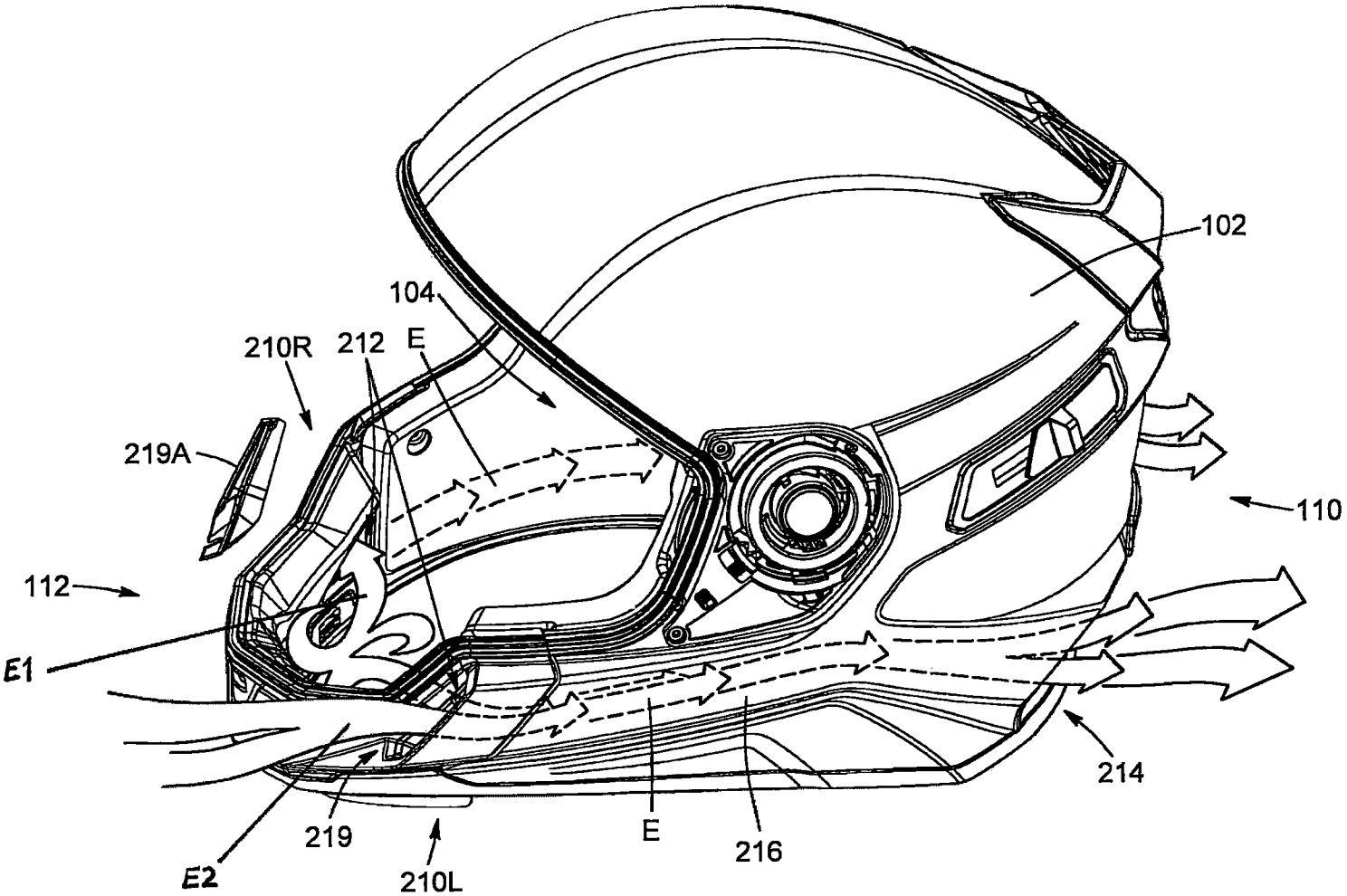
FIG. 4 is a side perspective view of the helmet shown in FIG. 1, with the transparent shield removed, and showing an evacuation airflow circulating through an evacuation subsystem, and showing an auxiliary inlet in accordance with an embodiment.
Figure 5:
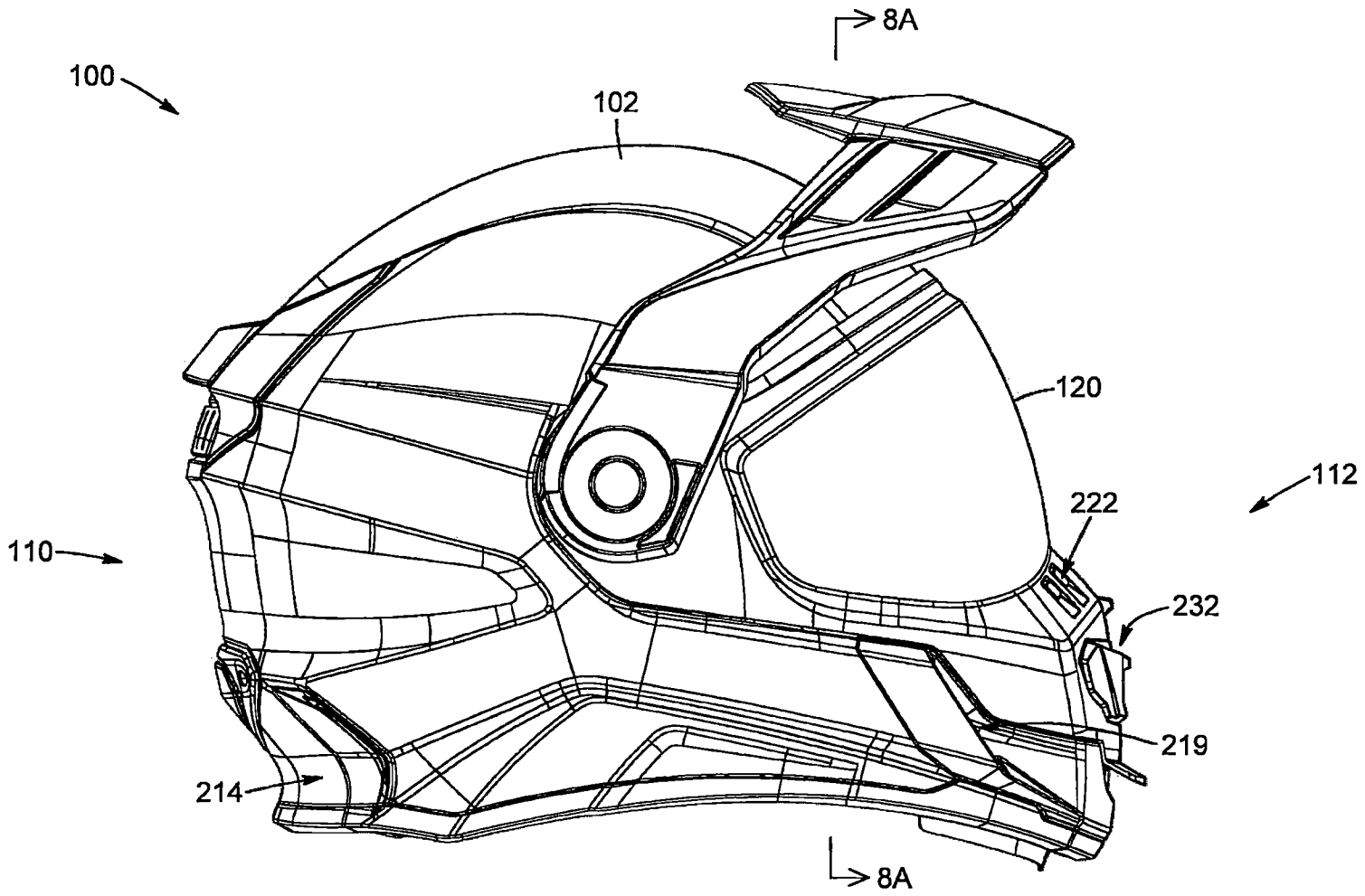
FIG. 5 is a side elevation view of the helmet shown in FIG. 1.

Now referring to FIGS. 4 and 5, the ventilation system 200 can include an evacuation subsystem 210 defining an evacuation airflow (E) for effectively evacuating humid air from within the cavity 104. In this embodiment, the evacuation subsystem 210 includes an evacuation inlet 212 communicating with the cavity 104, an evacuation outlet 214 communicating with the surrounding environment, and a channel 216 fluidly connecting the evacuation inlet 212 with the evacuation outlet 214. In some embodiments, the channel 216 can extend from the evacuation inlet 212 to the evacuation outlet 214 following a lateral side of the helmet shell 102. In some embodiments, the channel 216 can be formed simultaneously as the helmet shell 102 (e.g., during molding), or subsequently attached within the cavity 104. In other embodiments, the channel 216 can be inserted within or connected to the EPS liner of the helmet which can provide insulating properties to the channel 216. A person of skill in the art will readily understand that the channel 216 can be added to the helmet 100 using any suitable and/or known method. In addition, it is appreciated that the components of the evacuation subsystem 210 (i.e., the inlet, outlet and channel) are preferably positioned in the bottom section 106 of the shell 102 for reasons detailed hereinbelow.

When in use, i.e. when the user is wearing the helmet and riding on a motorcycle, snowmobile or other motorized vehicle, the helmet 100 typically travels through a surrounding airflow, causing a pressure differentiation between the front and back sections 110, 112. It is appreciated that the air pressure near the back section 110 is generally lower than the air pressure near the front section 112. Therefore, the evacuation airflow (E) will tend to travel from the front section 112 (high pressure) to the back section 110 (low pressure). This is a well-known characteristic in the art of fluid mechanics and will not be explained further. It is appreciated that the air within the cavity 104 will also be inclined to flow toward the low-pressure regions, such as the low-pressure zone and surrounding environment (near the back section 110). Accordingly, in this embodiment, the evacuation inlet 212 is positioned within the cavity 104, proximate the front section 112, (e.g., near the mouth and nose of the wearer) and the evacuation outlet 214 is positioned on the helmet shell 102, proximate the back section 110. In some embodiments, the evacuation outlet 214 can be positioned behind the wearer's head, and preferably close to his/her neck. However, it is appreciated that the evacuation outlet 214 can alternatively be positioned higher behind the wearer's head (e.g., in the top section 108). It should thus be readily understood that the evacuation airflow (E) will generally flow from the evacuation inlet 212 to the evacuation outlet 214 so as to be evacuated from the cavity 104. In this embodiment, the evacuation airflow can create a vacuum effect within the cavity 104 and can therefore drag humid air, such as exhaled air (E1), within the evacuation subsystem 210 to prevent fogging of the inner surface 122. It is appreciated that the mouth and nose of the wearer are preferably positioned in the low-pressure zone in order to facilitate the evacuation of exhaled air (E1) through the evacuation subsystem 210. As illustrated in FIG. 4, the evacuation subsystem 210 can include left and right evacuation subsystems 210L, 210R, respectively provided on the left and right sides of the helmet 100.

Referring more specifically to FIG. 4, the evacuation subsystem 210 can include an auxiliary inlet 219 provided on the helmet shell 102, near the front section 112 thereof, for fluidly connecting the surrounding environment with the channel 216. It will be appreciated that the air flowing through the auxiliary inlet 219 (E2) can merge with the evacuation airflow (E) within the channel 216, effectively increasing the vacuum effect within the cavity 104. In some embodiments, the auxiliary inlet 219 can be manually adjustable to control access of air flowing therethrough. For example, the auxiliary inlet 219 can be provided with a vent (not shown), adjustable between a closed configuration and an open configuration. Alternatively, the auxiliary inlet 219 can be adjusted using an inlet plug 219A removably connectable within the auxiliary inlet 219 to restrict/block the flow of air therethrough. Therefore, when additional drag is required to evacuate humid/exhaled air (E1) from the cavity 104, the vent can be adjusted in the open configuration to allow air to flow through the auxiliary inlet 219 and improve air evacuation.

Figure 6:
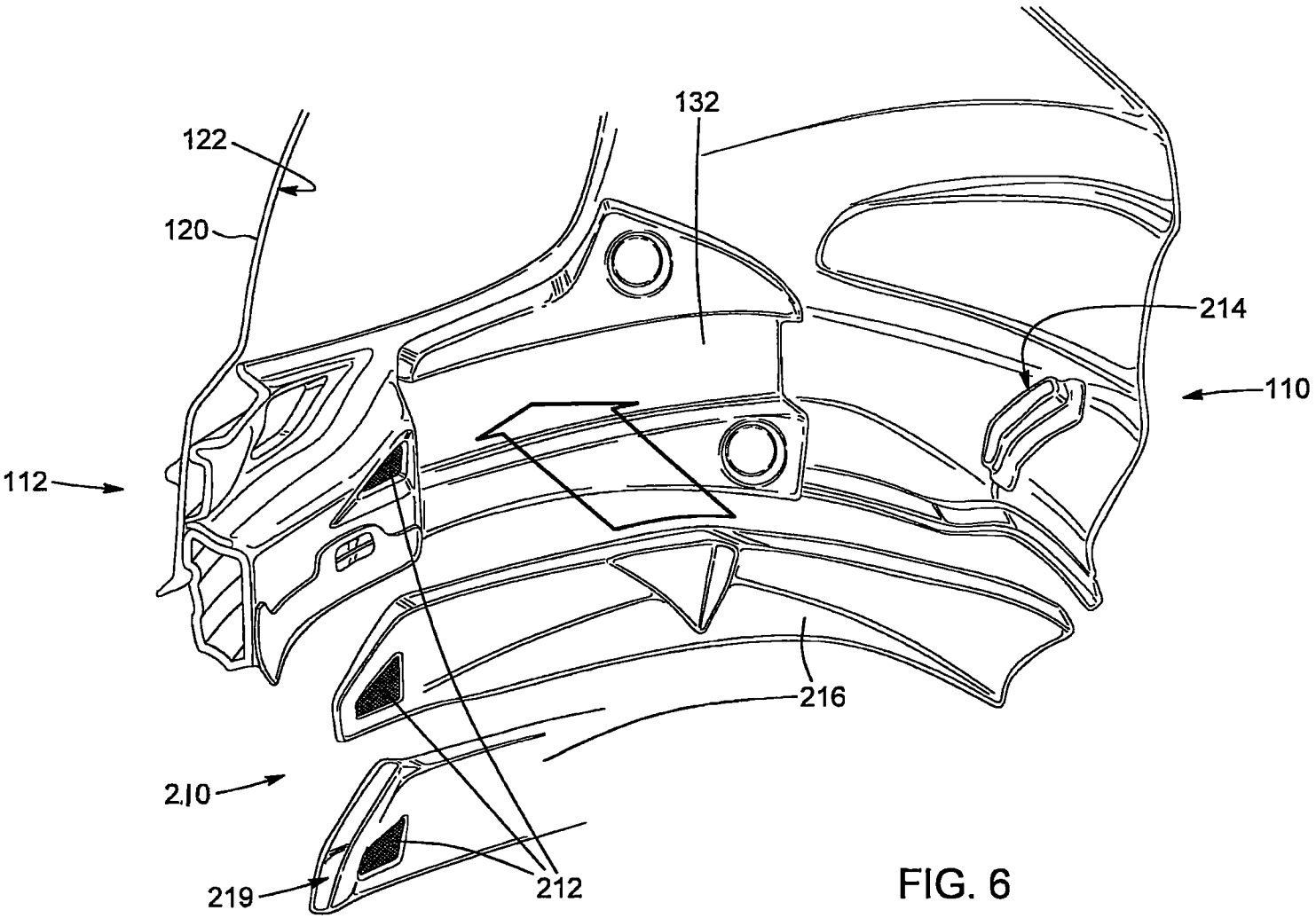
FIG. 6 is a partially exploded view of the helmet shown in FIG. 2A, showing possible embodiments of a channel to be positioned along a lateral side of the helmet, according to an embodiment.
Figure 6A:
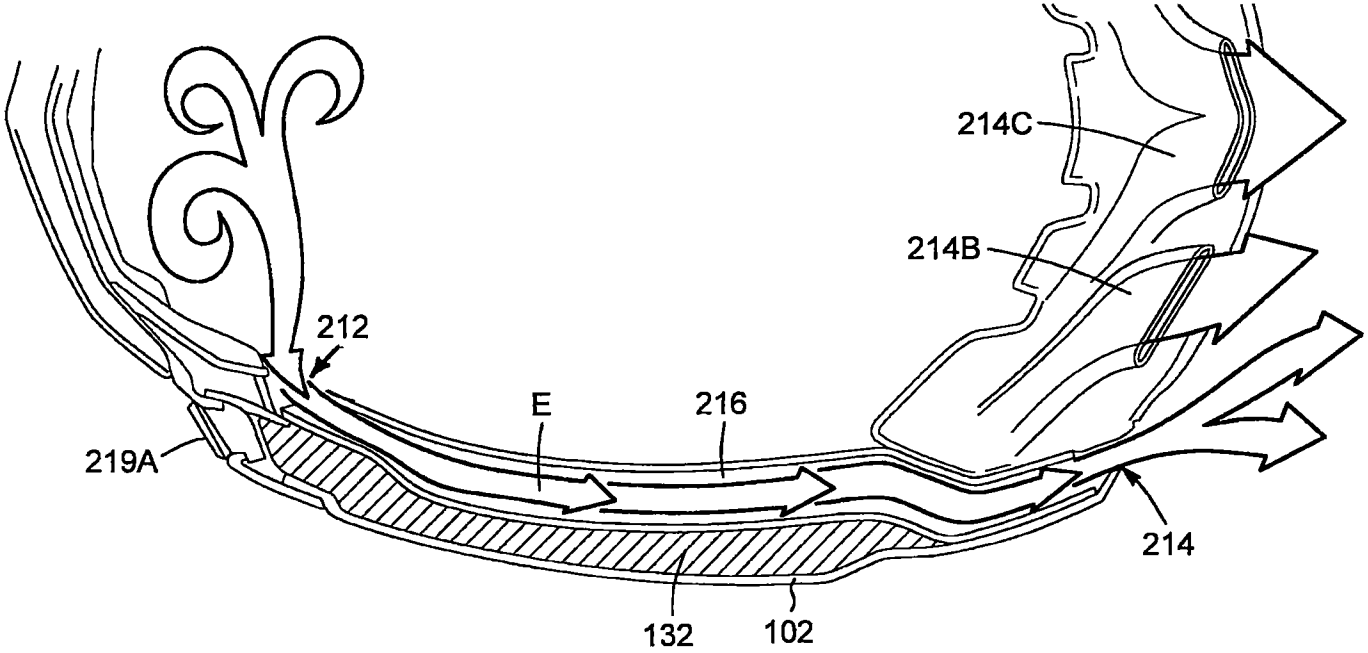
FIG. 6A is an enlarged view of the evacuation subsystem, showing multiple evacuation outlets positioned proximate the back section of the helmet shell, according to an embodiment.
Figure 6B:
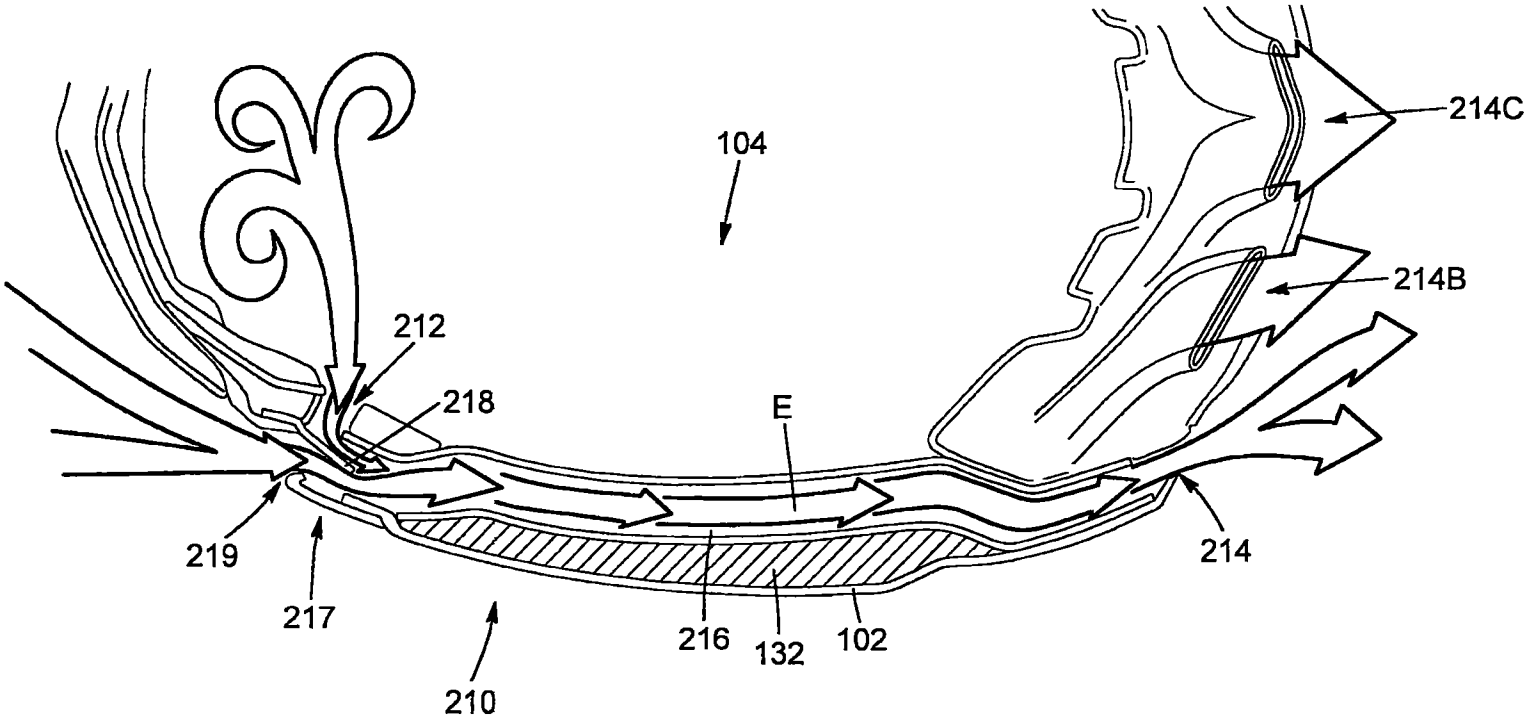
FIG. 6B is an enlarged view of the evacuation subsystem, showing the channel provided with the auxiliary inlet, and showing insulating material surrounding the channel of the evacuation subsystem, according to an embodiment.

Now referring to FIGS. 6 to 6B, the channel 216 can be defined within a thickness of the helmet shell 102, effectively isolating the channel 216 from the cavity 104. In other words, in this embodiment, air can access and exit the channel 216 solely via the evacuation inlet and outlet 212, 214. Additionally, the channel 216 can be insulated to prevent the accumulation of frost and/or hoarfrost therein, especially when using the helmet 100 in cold weather (e.g., while snowmobiling, skiing, etc.). It will be readily understood by a person skilled in the art that frost and/or hoarfrost located within the channel 216 can obstruct or completely block the evacuation airflow (E), thus preventing the humid air from exiting the cavity 104. In some embodiments, the channel 216 can be surrounded by an insulating material 132 along the entire length thereof. However, it is appreciated that the insulating material 132 can surround one or more sections provided along the length of the channel 216. In this embodiment, the insulating material 132 is positioned between the channel 216 and the helmet shell 102 to effectively insulate the channel 216 from the outside temperatures, as illustrated in FIGS. 6A and 6B. For example, and without being limitative, the insulating material 132 can include foam materials and/or other known insulating materials such as polystyrene. In some embodiments, the auxiliary inlet 219 (FIG. 6B) can also be provided with insulating material 132 to prevent frost from gathering in or around the inlet 219. However, it is appreciated that the humid air does not travel through the auxiliary inlet 219 and therefore, insulating material 132 is optional.

In some embodiments, the evacuation subsystem 210 can be provided with additional evacuation outlets 214. As seen in FIGS. 6A and 6B, the evacuation subsystem 210 can include one or more secondary outlets 214B positioned near the back section between the center of the helmet shell 102 and the evacuation outlet 214. Additionally, the evacuation subsystem 210 can include a central outlet 214C positioned substantially in the center of the helmet shell 102, proximate the back section 110. It should be understood that the secondary outlets 214B can be provided on either side of the central outlet 214C, and that the evacuation outlets 214 can also be provided on either side of the central outlet 214C further than the secondary outlets 214B. However, it is appreciated that the secondary and central outlets 214B, 214C are optional, and that they can be positioned at any suitable location on the helmet shell 102 to facilitate evacuation of humid air.

Referring more specifically to FIG. 6B, in addition to FIG. 2, the channel 216 of the evacuation subsystem 210 can include a converging section 217 having a reducing cross-sectional area adapted to increase velocity of the evacuation airflow within the channel 216. In this embodiment, the converging section 217 is located between the auxiliary inlet 219 and the evacuation inlet 212 in order to increase the velocity as the airflow passes in front of the evacuation inlet 212, effectively increasing the vacuum effect within the cavity 104. The converging section 217 can include a converging panel 218 extending within the channel 216 from one of the sides in order to reduce the cross-sectional area thereof. However, it is appreciated that other methods of reducing the cross-sectional area of the channel 216 can be suitable, such as simply tapering the walls of the channel 216 toward each other along a section of the channel 216. It should also be noted that the channel 216 can have more than one converging section 217 provided at different locations along the length of the channel 216.

Figure 7:
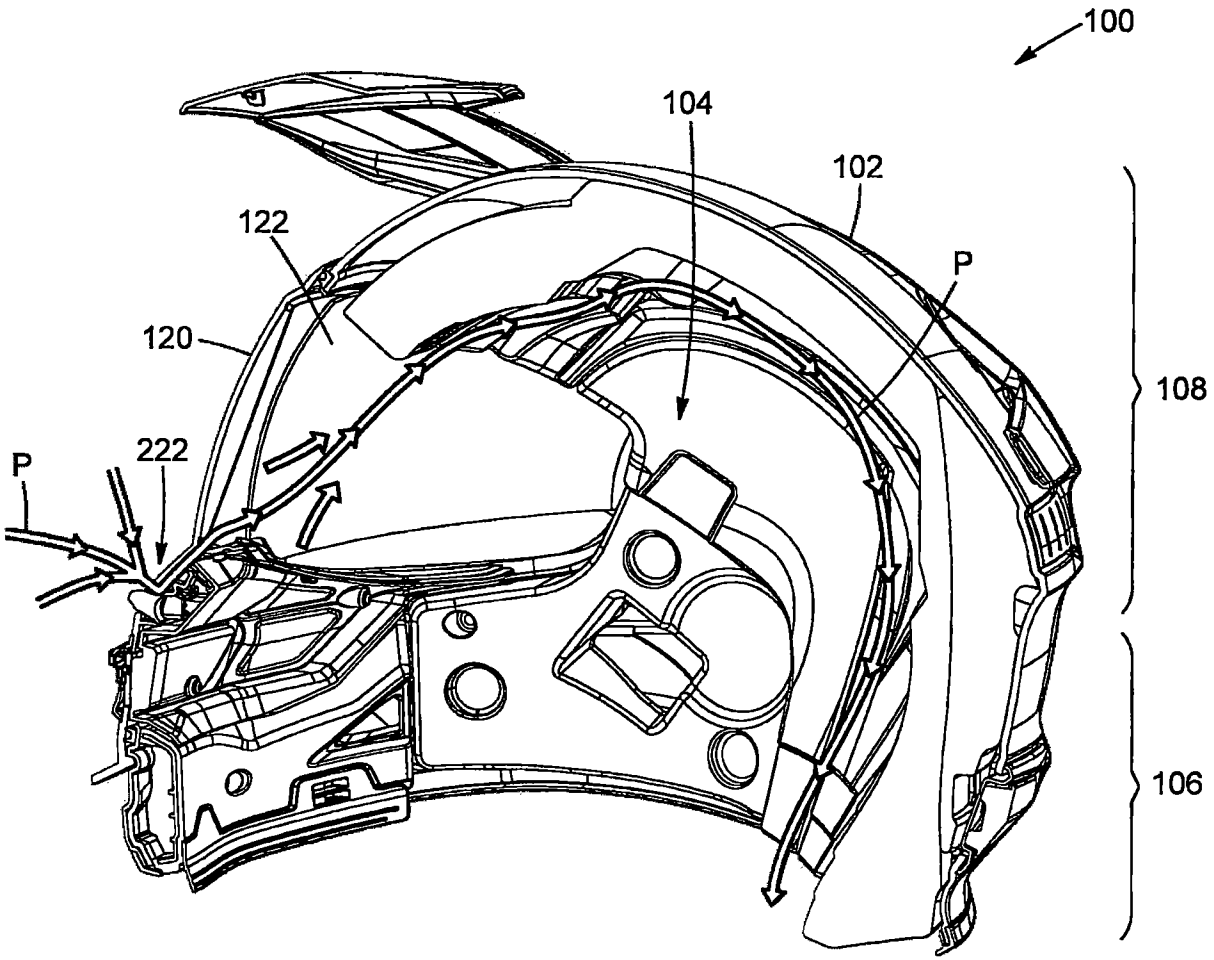
FIG. 7 is an enlarged view of a pressurizing subsystem, showing a pressurizing airflow flowing within the cavity, according to an embodiment.
Figure 7A:
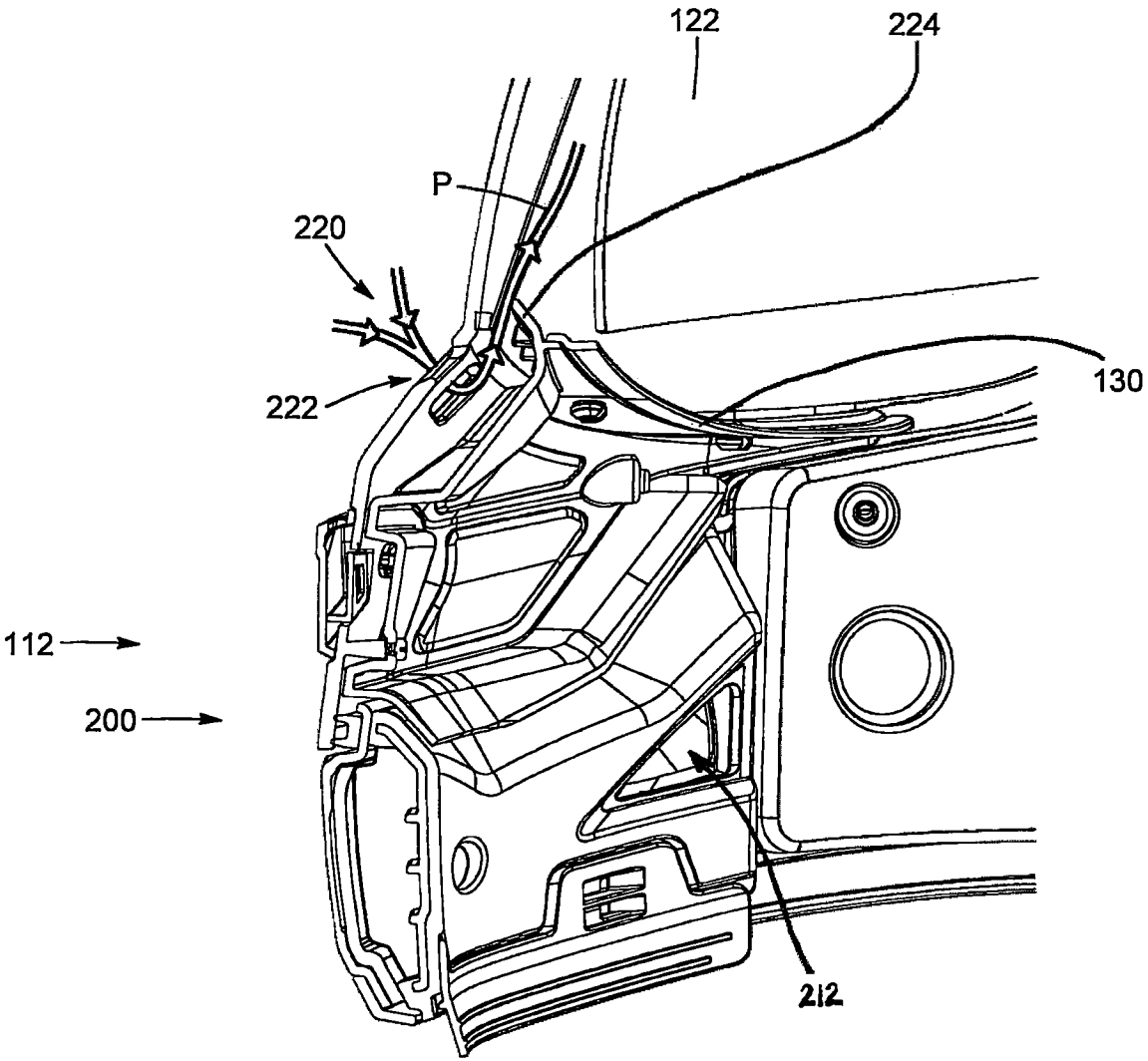
FIG. 7A is a sectional view of the helmet shown in FIG. 2, showing the path of the pressurizing airflow, according to an embodiment.
Figure 7B:
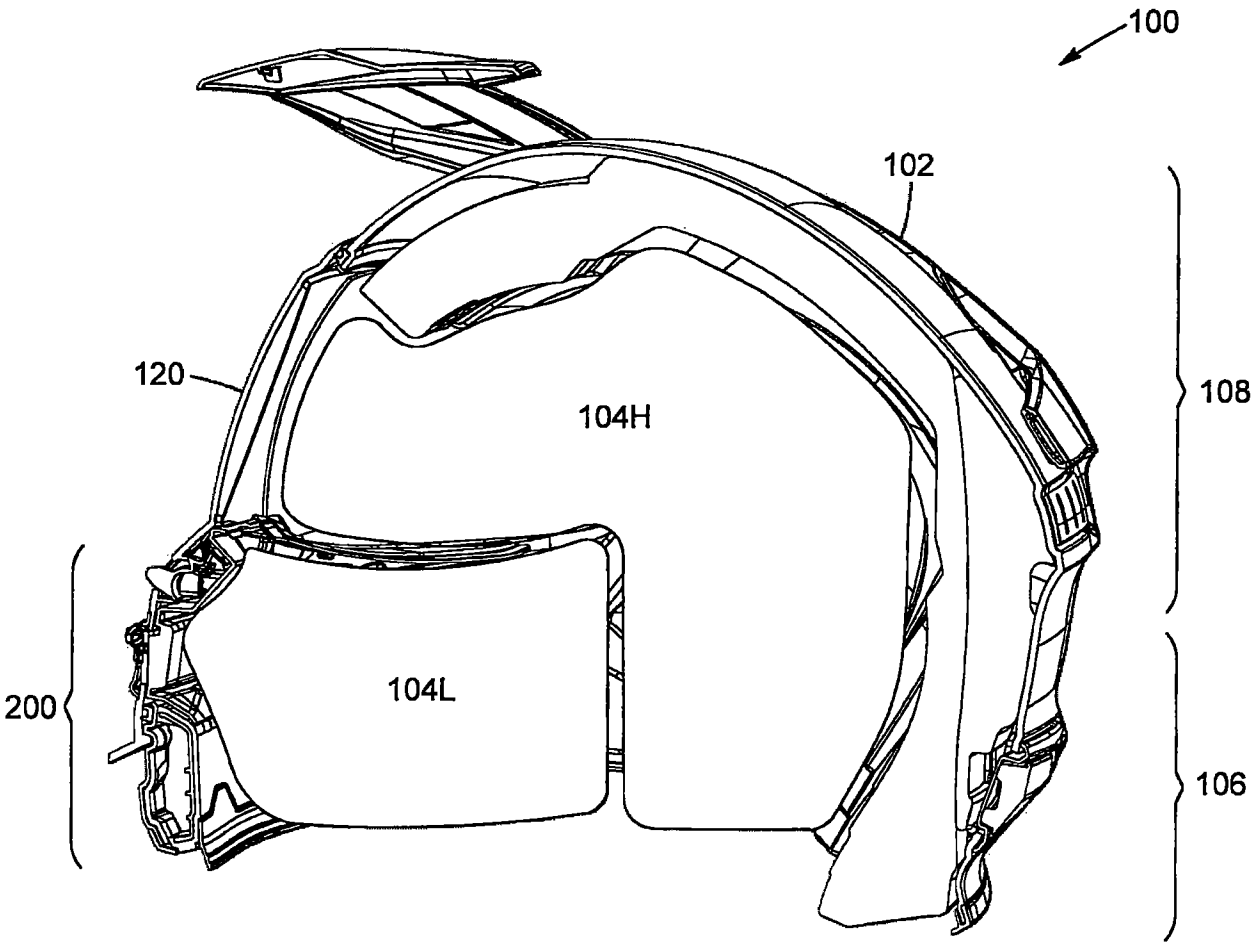
FIG. 7B is the sectional view shown in FIG. 3, showing the high and low-pressure zones being restricted by the pressurizing airflow, according to an embodiment.

Now referring to FIGS. 7 to 7B, the ventilation system 200 can further include a pressurizing subsystem 220 for admitting a pressurizing airflow (P) within the cavity 104 to define the aforementioned high and low-pressure zones 104H, 104L (FIG. 7B). In this embodiment, the pressurizing subsystem 220 includes a pressurizing inlet 222 fluidly connecting the surrounding environment with the cavity 104. The pressurizing inlet 222 can be positioned on the helmet shell 102 proximate the front section 112 to facilitate access of the pressurizing airflow within the cavity 104. In some embodiments, the pressurizing inlet 222 can be positioned on, or below the transparent shield 120, substantially opposite the nose of the wearer within the cavity 104. However, it is appreciated that the pressurizing inlet 222 can be positioned at any suitable location on the helmet shell 102, such as further below or above the transparent shield 120. It should also be noted that the pressurizing subsystem 220 can include more than one pressurizing inlet 222 positioned at different locations on the helmet shell 102. In this embodiment, the pressurizing subsystem 220 includes four pressurizing inlets 222 grouped in pairs on the front section 112 of the helmet shell 102. It should be understood that the pressurizing inlet 222 is preferably positioned vertically higher than the evacuation inlet 212 to ensure that the pressurizing airflow (P) and evacuation airflow (E) are effectively separated within the cavity 104 (i.e., are not fluidly connected).

The pressurizing subsystem 220 can be provided with a deflector 224 adapted to redirect the pressurizing airflow (P) toward the top section 108 within the cavity 104. In some embodiments, the deflector 224 can be positioned behind the pressurizing inlet 222 to effectively redirect the pressurizing airflow (P) as it enters the cavity 104 through the pressurizing inlet 222. Additionally, the deflector 224 can be positioned opposite the separator 130, as seen in FIG. 7A, to effectively redirect the pressurizing airflow (P) above the separator 130 and in the top section 108. It should be understood that redirecting the pressurizing airflow toward the top section 108 can pressurize that region of the cavity 104, which defines the high and low-pressure zones 104H, 104L. In this embodiment, the pressurizing airflow (P) can exit the cavity 104 through the bottom opening of the helmet 100 (i.e., around the neck of the wearer). It should be noted that the pressurizing airflow typically exits the cavity 104 proximate the back section 110, as the airflow (P) flows along the interior surface of the helmet shell 102, as illustrated in FIG. 7. As such, the high-pressure zone 104H can be defined in the top section 108, and also partially in the bottom section 106 proximate the back section 110. Consequently, the low-pressure zone 104L can be limited to the bottom section 106 proximate the front section 112, effectively urging the exhaled air toward the evacuation inlet 212, as represented in FIG. 7B.

Referring more specifically to FIGS. 7 and 7A, the pressurizing airflow (P) can be further adapted to clear the inner surface 122 if fog had already started to accumulate thereon. As illustrated in FIG. 7, the pressurizing airflow can travel along the inner surface 122 of the transparent shield 120 due to the presence of the deflector 224, effectively carrying humidity (e.g., humid air) away from the transparent shield 120. In addition, it is appreciated that the pressurizing inlet 222 can be selectively adjustable, in a similar fashion to the auxiliary inlet 219 (FIG. 4), to control access of air flowing therethrough. Therefore, in the situation where fog has started to accumulate on the inner surface 122, the pressurizing inlet 222 can be adjusted in the open configuration to allow the pressurizing airflow (P) to access the cavity 104 and carry any moisture away from the inner surface 122. It is appreciated that the pressurizing airflow can simply provide fresh air within the cavity 104 in order to cool the interior of the helmet shell 102 (i.e., the head and face of the wearer).

Figure 8:
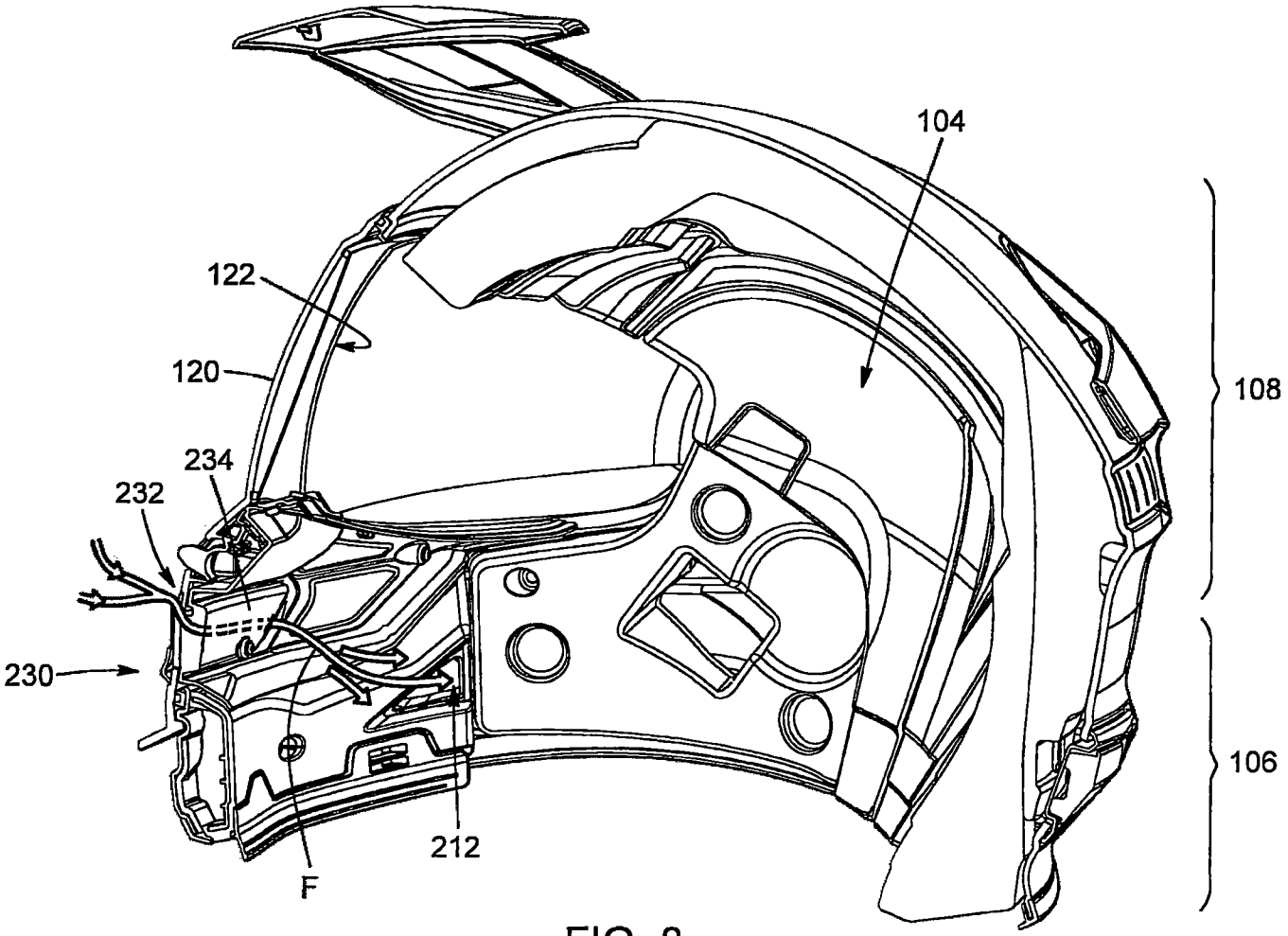
FIG. 8 is the sectional view shown in FIG. 2A, showing a frontal subsystem and a frontal airflow flowing within the cavity, according to an embodiment.
Figure 8A:
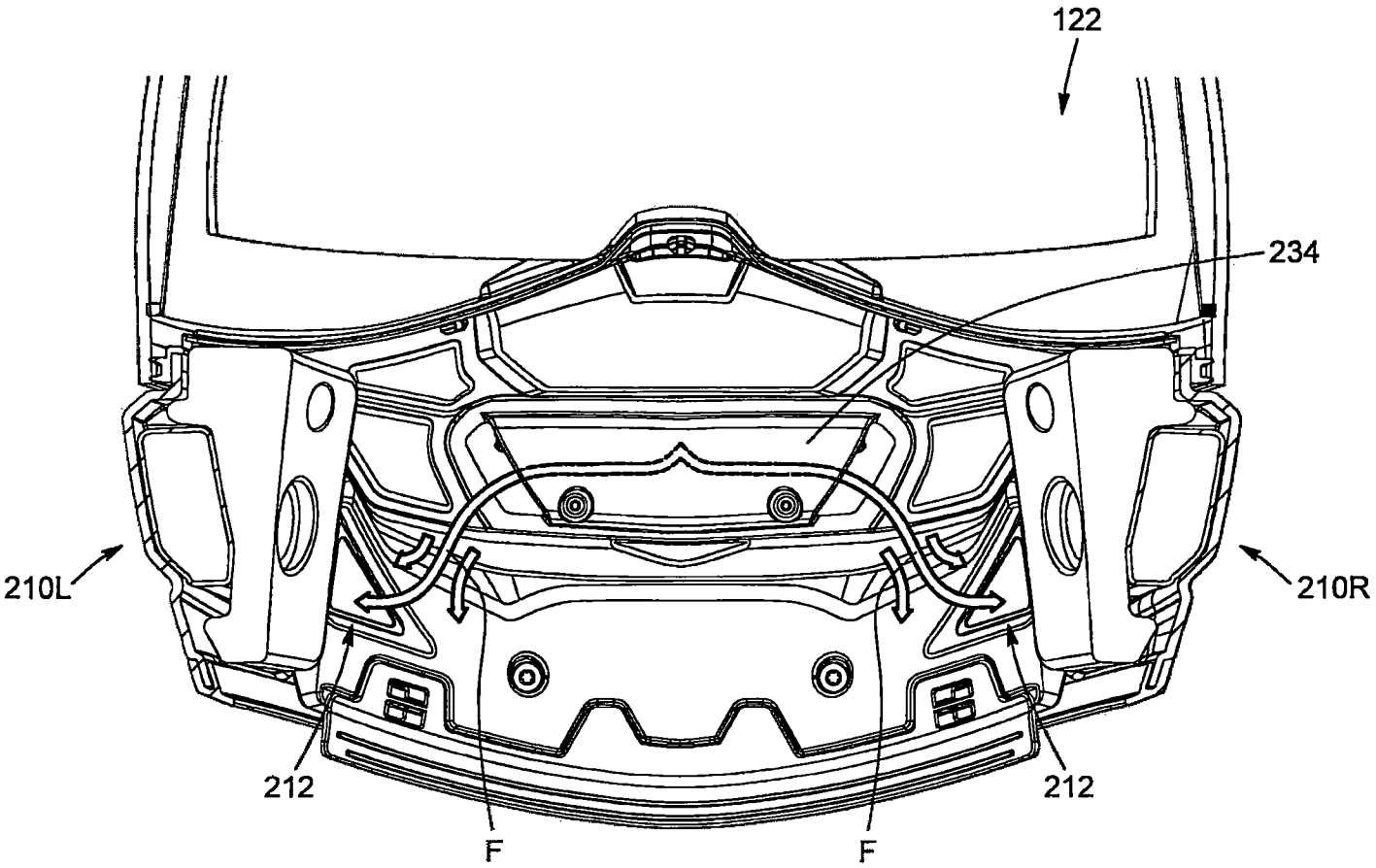
FIG. 8A is a sectional view of the helmet taken along cross-section lines 8A-8A of FIG. 5, showing the frontal airflow being redirected within the cavity, according to an embodiment.

With reference to FIGS. 8 and 8A, in addition to FIG. 2, the ventilation system 200 can further include a frontal subsystem 230 for admitting a frontal airflow (F) within the cavity 104 to provide fresh air to the bottom section 106 (e.g., to the nose and mouth of the wearer) and to increase the redirection/drag of exhaled air toward the evacuation inlet 212. It should thus be understood that the evacuation subsystem 210 and frontal subsystem 230 can be fluidly connected to one another within the low-pressure zone. In this embodiment, the frontal subsystem 230 includes a frontal inlet 232 fluidly connecting the surrounding environment with the bottom section 106 within the cavity 104. The frontal inlet 232 can be positioned on the helmet shell 102 proximate the front section 112 thereof to facilitate the access of the frontal airflow within the cavity 104. In some embodiments, the frontal inlet 232 can be positioned below the transparent shield 120, and below the pressurizing inlet 222, substantially opposite the mouth of the wearer within the cavity 104. However, it is appreciated that the frontal inlet 232 can be positioned at any suitable location on the helmet shell 102, and that the frontal subsystem 230 can include one or more frontal inlets 232 for admitting the frontal airflow within the cavity 104.

In some embodiments, the frontal subsystem 230 includes a frontal deflector 234 adapted to redirect the frontal airflow (F) laterally within the cavity 104. It should be understood that the frontal deflector 234 is preferably positioned behind the frontal inlet 232 in order to prevent the frontal airflow from directly contacting the wearer's face, which can be uncomfortable. The frontal deflector 234 can be adapted to divide and redirect the frontal airflow (F) laterally on either side of the wearer's face. Therefore, it should be understood that the frontal airflow (F) is redirected, at least partially, toward the evacuation inlets 212 of the left and right evacuation subsystems 210L, 210R to further improve the evacuation of humid/exhaled air from the cavity 104. In this embodiment, the frontal inlet 232 is positioned substantially in the center of the helmet shell 102, in between the evacuation inlets 212.

It should be noted that the frontal airflow (F) is fluidly connected to the evacuation airflow (E) but is however generally separated from the pressurizing airflow (P) due to the separator and pressure differentiation within the cavity 104. In addition, it is appreciated that the frontal airflow can simply provide fresh air to the wearer when needed, such as during periods of intense physical effort. In some embodiments, the frontal inlet 232 can be selectively adjustable, in a similar fashion to the auxiliary and pressurizing inlets 219, 222, to control access of air flowing therethrough.

Figure 9:
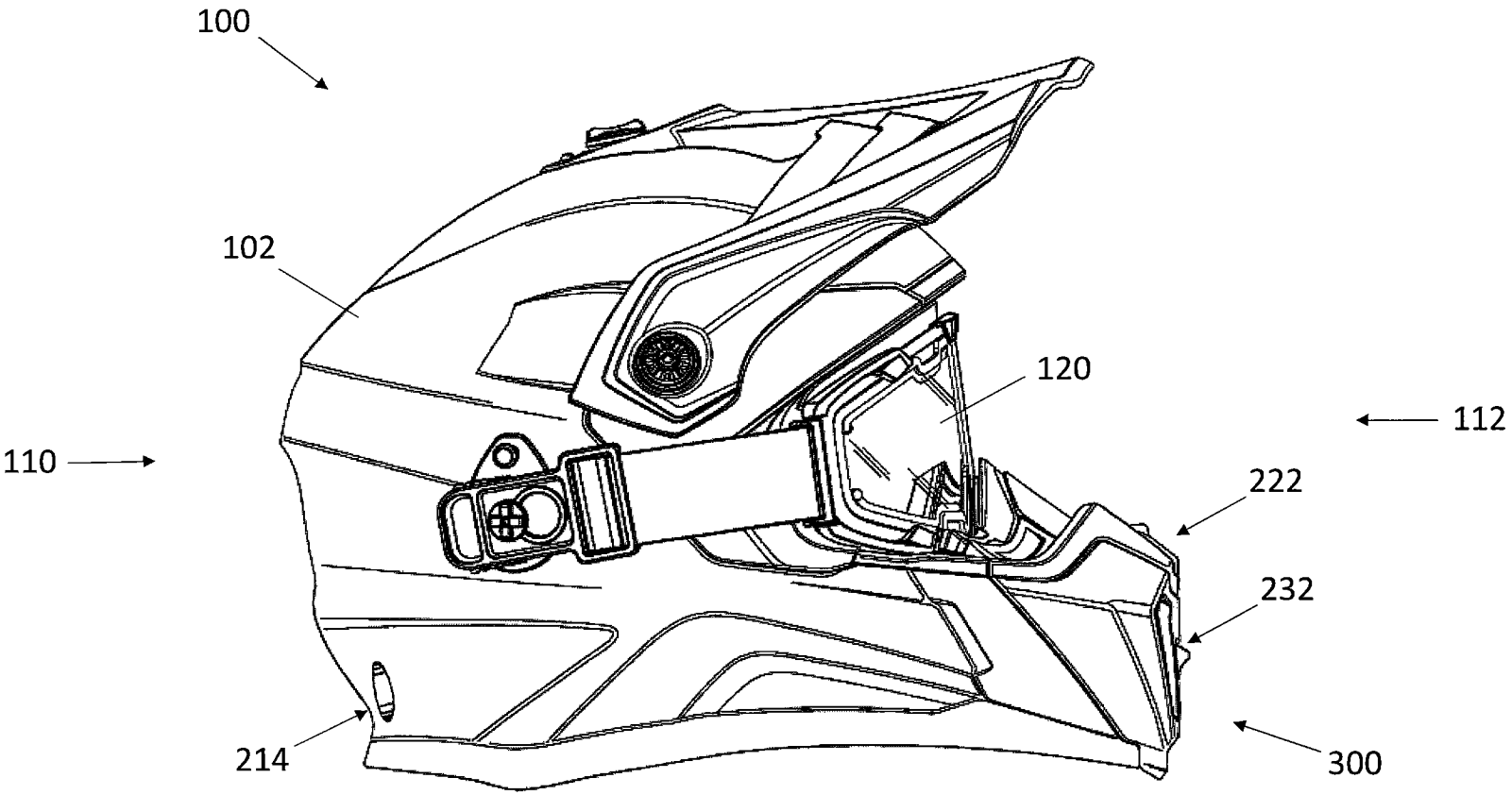
FIG. 9 is a side elevation view of a helmet according to an embodiment, showing a muzzle mounted to a front section of the helmet.
Figure 10:
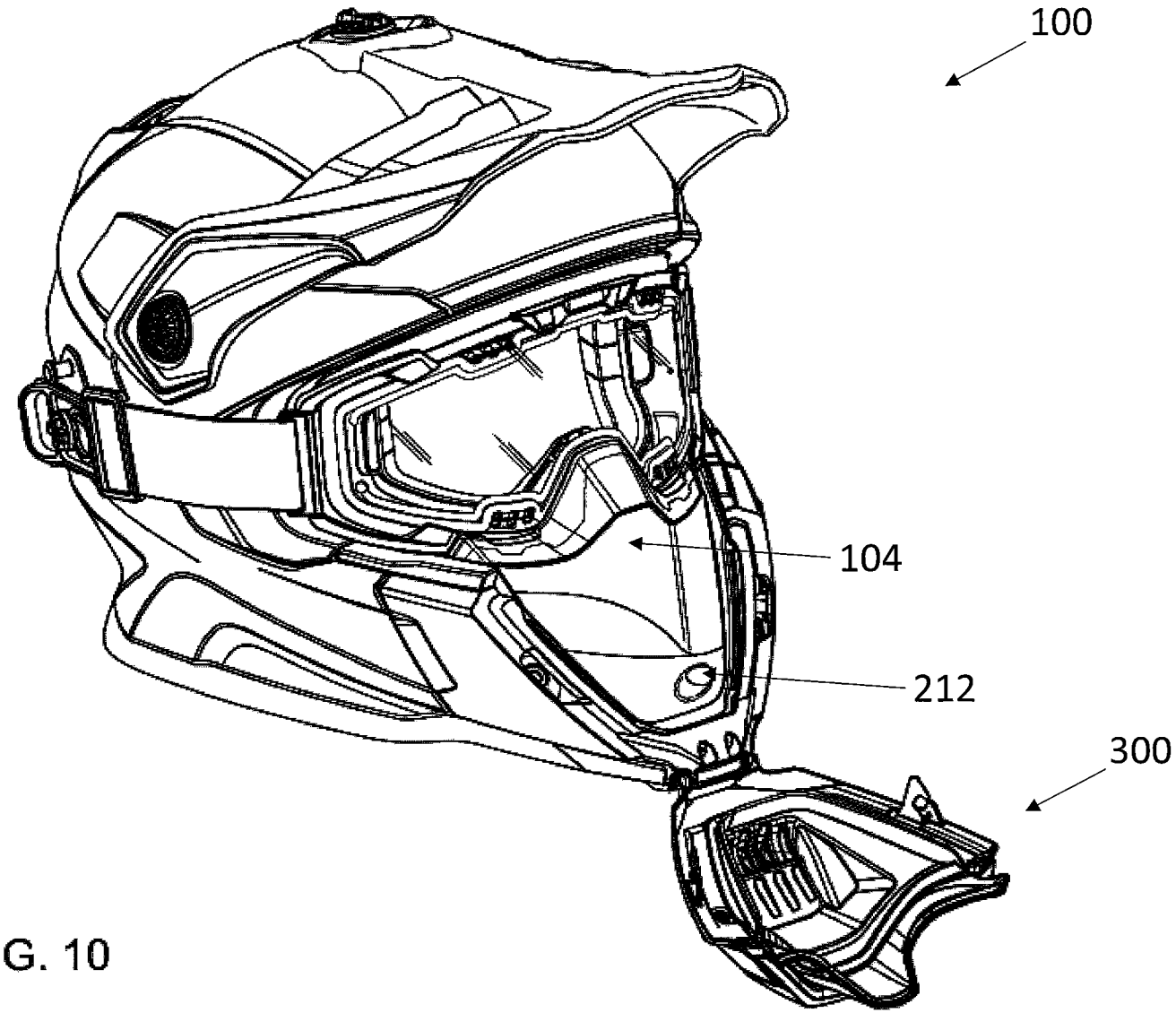
FIG. 10 is a perspective view of the helmet shown in FIG. 9, showing the muzzle in an open configuration, according to an embodiment.

Now referring to FIGS. 9 and 10, the front section 112 can include a muzzle 300 hingedly and/or removably connected to the helmet shell 102. As such, a portion of the front section can be opened or removed by correspondingly pivoting or disconnecting the muzzle 300 from the helmet 100. It should be understood that pivoting or removing the muzzle 300 can allow air from the surrounding environment to freely enter the cavity 104 and cool the interior of the helmet. Additionally, removing the muzzle 300, therefore freeing the mouth of the wearer, can be advantageous in certain situations, such as when the wearer wants/needs to communicate/talk with someone else for example. In some embodiments, the pressurizing inlet 222 and/or the frontal inlet 232 can be positioned on the muzzle 300. However, it should be noted that the evacuation inlets 212 are preferably positioned within the cavity 104, on either side of the muzzle 300, so that when the muzzle is opened (FIG. 10) or removed (not shown), exhaled air can still be evacuated via the evacuation subsystem.

Referring broadly to FIGS. 1 to 8A, it should be understood that the ventilated helmet 100 provides the wearer a method of evacuating humid air from within the cavity 104 while using the helmet (e.g., while riding a snowmobile or motorcycle) so as to have the helmet 100 move through the surrounding air. In this embodiment, the method includes the step of pressurizing the top section 108 within the cavity 104 via the pressurizing subsystem 220 to define the high and low-pressure zones 104H, 104L.

It is appreciated that in order to pressurize the top section, the pressurizing airflow (P) must be admitted through the pressurizing inlet 222, which is then upwardly deflected by the deflector 224 positioned within the cavity 104. As the cavity pressurizes, the evacuation airflow is defined via the evacuation subsystem 210 to effectively evacuate humid air within the cavity. Once the cavity is pressurized, the evacuation airflow (E) will urge humid air from within the cavity towards the evacuation inlet 212, advantageously positioned in the low-pressure zone 104L. As such, exhaled air will be similarly urged to the evacuation inlet 212 by the vacuum effect produced by the evacuation airflow. The evacuation airflow then flows through the channel 216, and exits the channel to the surrounding environment via the evacuation outlet 214. The method can further include the step of admitting the frontal airflow (F) via the frontal inlet 232 of the frontal subsystem 230 in order to further drag exhaled air toward the evacuation inlet 212.

It should be appreciated from the present disclosure that the ventilated helmet offers improvements and advantages as described above. Indeed, the ventilation system having multiple adjustable subsystems to the ventilation system presents multiple advantages. Firstly, the temperature within the cavity can be controlled via the plurality of adjustable airflow inlets provided around the helmet shell. Additionally, the pressure differentiation created within the cavity ensures that the exhaled air does not flow upwardly toward the transparent shield, thus preventing fogging thereof. Finally, if ever fog would accumulate on the transparent shield, the pressurizing airflow can flow along the inner surface of the shield to carry off the humid air away from the inner surface.

While the ventilated helmet has been described in conjunction with the exemplary embodiments described above, many equivalent modifications and variations will be apparent to those skilled in the art when given this disclosure. Accordingly, the exemplary embodiments set forth above are considered to be illustrative and not limiting. The scope of the claims should not be limited by the preferred embodiments set forth in this disclosure but should be given the broadest interpretation consistent with the description as a whole.

The invention claimed is:

1. A helmet comprising:

a shell having an inner surface defining a cavity and an outer surface, the shell further having a front section provided with an opening;

a visor operatively coupled to the shell and adapted to cover the opening;

a ventilation system, comprising:

a ventilation channel integrally formed with the shell and being adapted to enable fluid flow therealong, the ventilation channel having a converging-diverging section configured to create a pressure differentiation along the ventilation channel and increase velocity of the fluid flow along the ventilation channel;

a ventilation inlet provided along the inner surface of the shell and being adapted to establish fluid communication between the cavity and the ventilation channel;

a ventilation outlet provided along the outer surface of the shell and being adapted to establish fluid communication between a surrounding environment and the ventilation channel downstream of the converging-diverging section; and an auxiliary inlet provided along the outer surface of the shell below the opening and being adapted to establish fluid communication between the surrounding environment and the ventilation channel upstream of the converging-diverging section.

2. The helmet of claim 1, wherein the converging-diverging section comprises a converging portion and a diverging portion, and wherein the ventilation inlet is provided between the converging portion and the diverging portion.

3. The helmet of claim 1, wherein the ventilation inlet is adapted to establish fluid communication between the cavity and the ventilation channel upstream of the converging-diverging section.

4. The helmet of claim 1, wherein the ventilation channel comprises a panel extending therein, the panel being part of the converging portion and is adapted to reduce a cross-sectional area of the ventilation channel.

5. The helmet of claim 4, wherein the panel extends between the ventilation inlet and the auxiliary inlet.

6. The helmet of claim 1, wherein a cross-sectional area of the ventilation channel is reduced between the ventilation inlet and a downstream portion of the ventilation channel.

7. The helmet of claim 1, wherein a cross-sectional area of the ventilation channel is reduced between the auxiliary inlet and a downstream portion of the ventilation channel.

8. The helmet of claim 1, wherein a distance between the ventilation inlet and the ventilation outlet is less than a distance between the auxiliary inlet and the ventilation outlet.

9. The helmet of claim 1, wherein at least a portion of the ventilation channel is at least partially defined by the inner surface of the shell, the outer surface of the shell or a combination thereof.

10. The helmet of claim 1, wherein the ventilation channel is at least partially defined in a thickness of the shell.

11. The helmet of claim 10, further comprising insulating material provided along the ventilation channel and positioned between the ventilation channel and the outer surface of the shell.

12. The helmet of claim 1, wherein a portion of the ventilation channel located between the auxiliary inlet and the ventilation outlet protrudes from the shell.

13. The helmet of claim 1, wherein the ventilation system comprises left and right ventilation channels extending on respective sides of the helmet, each ventilation channel having a corresponding ventilation inlet, ventilation outlet, auxiliary inlet and converging-diverging section.

* * * * *